US007341448B2

(12) United States Patent
Groehl

(10) Patent No.: US 7,341,448 B2
(45) **Date of Patent: *Mar. 11, 2008**

(54) GAS-FIRED HEATING APPARATUS

(75) Inventor: Alexander Groehl, Dolgesheim (DE)

(73) Assignee: Ceramat, S.Coop., Asteasu (Gipuzkoa) (ES)

( * ) Notice: Subject to any disclaimer, the term of this patent is extended or adjusted under 35 U.S.C. 154(b) by 20 days.

This patent is subject to a terminal disclaimer.

(21) Appl. No.: 11/179,989

(22) Filed: Jul. 12, 2005

(65) Prior Publication Data

US 2006/0014114 A1 Jan. 19, 2006

(30) Foreign Application Priority Data

Jul. 15, 2004 (DE) ..... 10 2004 034 138

(51) Int. Cl.
*F23D 5/00* (2006.01)

(52) U.S. Cl. ..... 431/114; 431/354; 126/39 R

(58) Field of Classification Search ..... 431/1, 431/2, 114, 350, 354, 355; 181/229; 126/512, 126/39 R, 41 R
See application file for complete search history.

(56) References Cited

U.S. PATENT DOCUMENTS 1,257,600 A * 2/1918 Madley ..... 431/114
1,809,684 A * 6/1931 Flanders ..... 369/163
2,199,771 A * 5/1940 Young ..... 431/114
2,531,139 A * 11/1950 Lilly et al. ..... 126/85 B
2,869,670 A * 1/1959 Hoffman ..... 181/229
2,897,885 A * 8/1959 Sherman ..... 431/153
3,720,497 A * 3/1973 Arenson ..... 431/114
3,773,075 A * 11/1973 Thompson et al. ..... 137/890
3,819,319 A * 6/1974 Schreter ..... 431/5
3,940,234 A * 2/1976 Reed et al. ..... 431/348
4,168,948 A * 9/1979 Okamoto et al. ..... 431/114
4,475,621 A * 10/1984 Cherington et al. ..... 181/212
4,747,391 A * 5/1988 Hanagan et al. ..... 126/41 R
4,829,978 A * 5/1989 Schlosser ..... 126/41 R
4,953,510 A 9/1990 Akkala et al.
4,983,510 A * 1/1991 Lardinois et al. ..... 435/4
5,408,986 A * 4/1995 Bigham ..... 126/110 R
5,875,739 A * 3/1999 Joyce ..... 122/18.31
6,106,276 A * 8/2000 Sams et al. ..... 431/114
6,148,954 A * 11/2000 Harris ..... 181/224
6,491,514 B1 * 12/2002 Hamad et al. ..... 431/114

(Continued)

FOREIGN PATENT DOCUMENTS

DE 38 42 842 A1 6/1990

(Continued)

*Primary Examiner*—Carl D. Price
(74) *Attorney, Agent, or Firm*—Michael J. Striker

(57) ABSTRACT

The gas-fired heating apparatus, especially a water heater, has a combustion chamber (2*a*); an atmospheric gas burner (5) within the combustion chamber (2*a*); a combustion gas/air supply system (18) having an intake device (16) for combustion gas and primary air to be mixed with the combustion gas, which is arranged outside of the combustion chamber, and an oscillation-damping air supply chamber (11) provided with at least one air inlet (12), which is connected upstream to the intake device (16) and is constructed as a Helmholtz resonator to reduce noise and stabilize combustion. To provide sufficient primary air under adverse spatial conditions the air supply chamber (11) has an exterior wall (11') and a pattern (13, 14) of perforations in the exterior wall, which are formed as additional air inlets for additional supply of the primary air.

9 Claims, 2 Drawing Sheets

U.S. PATENT DOCUMENTS

| | | | | |
|---|---|---|---|---|
| 6,945,196 | B1 * | 9/2005 | Hubert et al. | 122/14.31 |
| 2003/0111023 | A1 | 6/2003 | Carbone et al. | |
| 2003/0183446 | A1 * | 10/2003 | Shah et al. | 181/205 |
| 2004/0157179 | A1 * | 8/2004 | Garloch et al. | 431/114 |
| 2005/0175951 | A1 * | 8/2005 | Groehl et al. | 432/219 |
| 2005/0229581 | A1 * | 10/2005 | Bellucci et al. | 60/39.17 |

FOREIGN PATENT DOCUMENTS

| | | | |
|---|---|---|---|
| DE | 40 06 091 A1 | | 9/1990 |
| DE | 0 2004 006 091 B4 | * | 9/2005 |
| FR | 2544358 | * | 10/1984 |
| JP | DE2117337 B | * | 7/1977 |
| JP | 60-213706 | * | 10/1985 |
| JP | 213707 | * | 10/1985 |
| JP | 04-735512 | * | 3/1992 |
| JP | 60-213707 | * | 10/1995 |
| WO | 00/06947 | | 2/2000 |

* cited by examiner

PRIOR ART

GAS-FIRED HEATING APPARATUS

BACKGROUND OF THE INVENTION

1. Field of the Invention

The present invention relates to a gas-fired heating apparatus with at least one gas burner, which is arranged within a combustion chamber; an associated combustion gas/air supply system, which has an inlet for combustion gas and combustion air, which is arranged outside of the combustion chamber on the heating apparatus; and an oscillation-damping air supply chamber with at least one air inlet.

2. Related Art

These types of gas-fired heating apparatus typically include gas-fired water heaters or gas-fired heating units, like those used for industrial heating and fireplaces in homes.

Gas-fired water heaters are used in many different forms and in many different power stages in different applications both in the private and also the industrial sector. This sort of gas-fired water heater is used, for example, for preparation of heated service water in industry or of hot water for heating in homes.

A special embodiment of this sort of gas-fired hot water preparing apparatus is the so-called "water heater" marketed in the U.S.A., which typically prepares shower water in workplaces or the like. For example one such "water heater" is described in U.S. Pat. No. 4,953,510, which comprises a thermally insulated storage tank for supplying heated water. This water heater is combined with a heating device for heating the water. The device most frequently used for heating the stored water comprises an open atmospheric gas burner that produces hot exhaust gases including combustion products, which act on the bottom of the water storage tank and subsequently rise through a long exhaust pipe, which extends through the center of the storage tank. In this type of water heater the hot gases flowing upward in the exhaust pipe contact the inner surfaces of the pipe, while the water in the storage tank contacts with the outer surface of the pipe. While the combustion proceeds, the water within the storage tank is heated by conduction through the wall of the exhaust pipe.

Increasingly strict regulations to prevent pollution, especially when flammable vapors reach the open combustion area, and in regard to improvements of exhaust gas quality, have led to developments in the water heater field, which have produced a nearly completely closed combustion chamber (burning chamber), in which a complete pre-mixing gas burner, a so-called pre-mix burner is arranged. This sort of water heater is, e.g., described in U.S. Pat. No. 5,875,739 or U.S. Published Patent Application US 2003/0111 023 A1.

In German Patent Application 10 2004 006 091.6-13, which discloses the same subject matter as co-pending U.S. patent application Ser. No. 10/978,571, pressure conditions can occur in the combustion chamber of the above-described gas-fired heating apparatus with an atmospheric, complete pre-mixing gas burner arranged in an almost completely closed combustion chamber, such that resonances are produced so that the system oscillates. These resonance oscillations have the following disadvantages:

- no stable or uniform combustion is possible and exhaust gas quality is poor;
- disturbing loud noise is observed; and
- a backfire of flames through the combustion medium is possible, depending on the turbulence in the combustion chamber.

In order to prevent resonances from occurring in a gas-fired heating apparatus with at least one atmospheric gas burner, which is arranged within a nearly completely or completely closed combustion chamber and which is associated with a complete pre-mixing gas/air supply system with a combustion gas single-barrel nozzle, so that the associate gas-burner system is noise-free and combustion-stable operation can occur, the above-mentioned U.S. patent application Ser. No. 10/978,571 provides an oscillation-damping air supply chamber connected upstream to the intake device of the combustion gas/air supply system, which is arranged outside of the combustion chamber on the heating apparatus. The oscillation-damping air supply chamber is provided with at least one air inlet. Also the entrance to the single-barrel combustion gas nozzle is arranged within the oscillation-damping air supply chamber.

This oscillation-damping air supply chamber, which is based on the known acoustic resonator used for sound analysis, is also called a Helmholtz resonator, It is also known for use in blower-assisted gas burners and it is formed with regard to its volume and its configuration so that its resonance frequency is tuned to the oscillations or standing waves arising in the combustion chamber and at least strongly damps and preferably cancels them by interference.

Because of the Helmholtz resonator no resonance oscillations exist in the combustion chamber, so that the gas burner system can be noise-free and operate in a combustion-stable manner.

Additional advantages include:

- definite steady air supply,
- no effect of air motion on the gas firing, since the gas firing occurs within the combustion chamber, so that it is guaranteed that the combustion processes are not impaired,
- since the combustion air supply is definite and steady the quality of the combustion is improved, and
- dust or dirt found on the ground or floor cannot be drawn in, since the combustion air supply is conducted in above it.

It has been shown that under certain circumstances, especially when there is insufficient space in or on the gas-fired heating apparatus for the air supply chamber and thus the chamber cross-section is insufficient, the known oscillation-damping air supply chamber described in the above-mentioned U.S. patent application Ser. No. 10/978,571 and earlier unpublished German Patent application does not supply the gas burner with sufficient air. This effect causes poor combustion, i.e. high $NO_x$/CO values, so that the allowed exhaust gas quality cannot be exceeded.

SUMMARY OF THE INVENTION

It is an object of the present invention to provide a gas-fired heating apparatus of the above-described type, especially a water heater, so that the gas burner is supplied with sufficient combustion air by means of an oscillation-damping air supply chamber, without production of disturbing noise.

These objects and others which will be made more apparent hereinafter are attained in a gas-fired heating apparatus comprising a combustion chamber, a gas burner arranged within the combustion chamber and a combustion gas/air supply system associated with the gas burner, the combustion gas/air supply system having an intake device for combustion gas and primary combustion air to be mixed with the combustion gas, which is arranged outside of the combustion chamber on the heating apparatus and an oscillation-damping air supply chamber connected to the intake device, which is provided with at least one air inlet and formed as a Helmholtz resonator.

According to the invention the oscillation-damping air supply chamber is provided with at least one perforation, preferably a plurality of perforations comprising a plurality of through-going holes or through-going openings arranged in a pattern, in an exterior wall of the air supply chamber, which acts as at least one additional air inlet for additional supply of primary combustion air to the air supply chamber.

Because of the perforation or perforations in the exterior wall of the oscillation-damping air supply chamber additional combustion air can be admitted into the air supply chamber besides that coming in through the main air inlet or inlets, which improves the combustion substantially and provides better exhaust gas quality. However the perforation or perforations in the wall are designed in regard to their structure and dimensions so that the oscillation-damping function of the air supply chamber remains completely the same.

Additional features of preferred embodiments are claimed in the appended dependent claims and described in more detail in the accompanying detailed description.

BRIEF DESCRIPTION OF THE DRAWING

The objects, features and advantages of the invention will now be illustrated in more detail with the aid of the following description of the preferred embodiments, with reference to the accompanying figures in which.

DETAILED DESCRIPTION OF THE INVENTION

Figure 1:
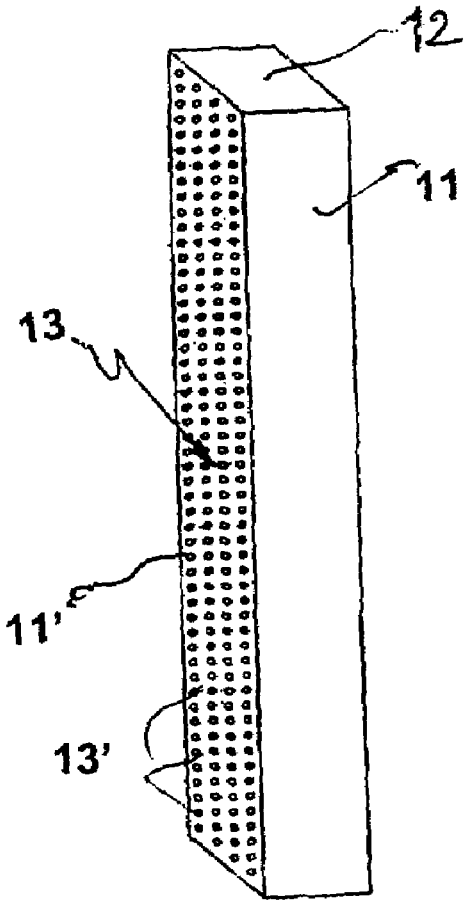
FIG. 1 is a perspective view of a parallelepiped-shaped oscillation-damping air supply chamber according to the present invention with perforations comprising a matrix array of through-going holes.

FIG. 1 of the previously cited U.S. patent application Ser. No. 10/978,571, whose subject matter is incorporated here by reference, is included in the drawings here as FIGS. 3A and 3B for an improved understanding of the present invention.

Figure 3A:
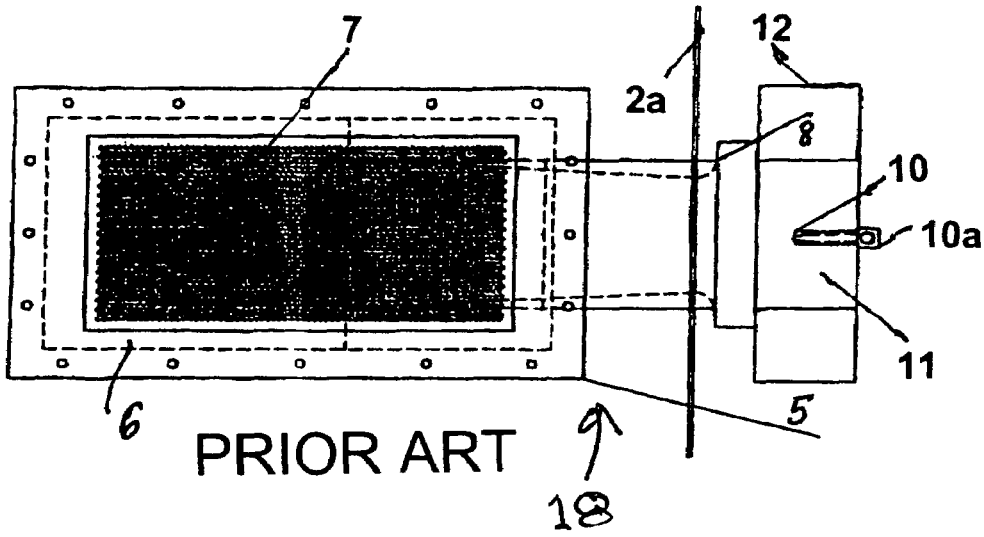
FIGS. 3A and 3B are respective top plan and side views of an atmospheric gas burner for a gas-fired water heater as described in U.S. patent application Ser. No. 10/978,571, which is arranged within an almost completely closed combustion chamber, in which a parallelepiped-shaped oscillation-damping air supply chamber is connected upstream to an intake device of the combustion air supply system outside of the combustion chamber.
Figure 3B:
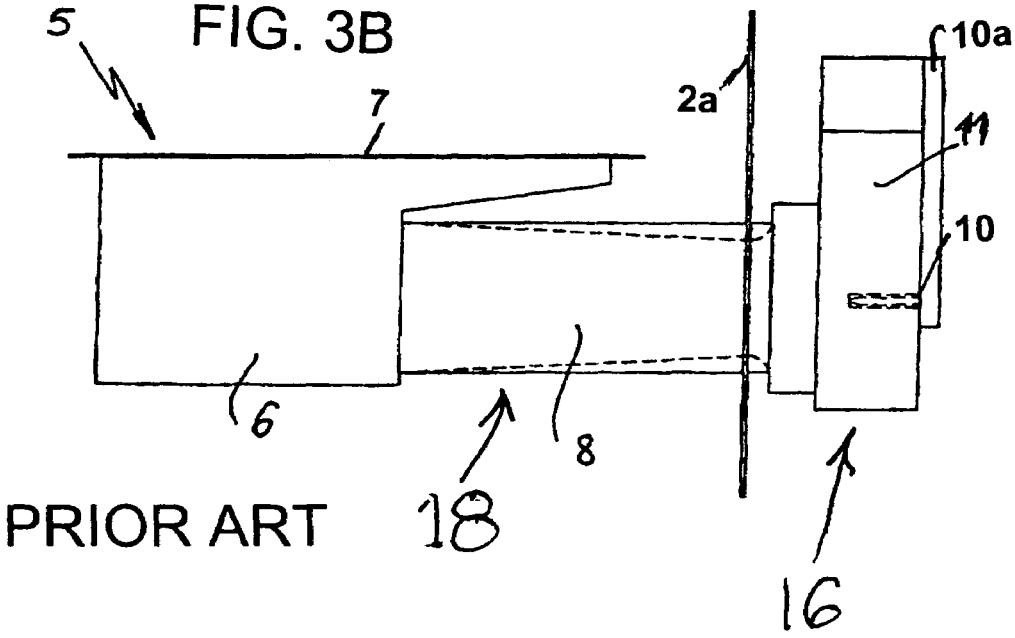

FIGS. 3A and 3B shows a first embodiment of an atmospheric gas burner 5, which is constructed according to the known gas burner described in US Published Patent Application 2003/0 111 023 A1. This burner is called an atmospheric gas burner, which burns combustion gas without blower assistance. This gas burner 5 is arranged within a combustion chamber of a heating apparatus, for example a water heater, which is almost completely or completely closed. Only the wall 2*a* of the combustion chamber is shown in order to simplify the illustration in the drawing. In fact, the wall 2*a* can be part of a door for the combustion chamber.

The atmospheric gas burner 5 has a planar rectangular burner mat or burner plate 7, which is formed by a conventional inserted component, e.g. comprising ceramic fibers, which is marketed under the trademark CERMAT®. The burner mat or plate 7 can have a circular, oval or any arbitrary form. It is also possible that it comprises metal fibers or ceramic mats or stones.

The gas burner 5 has a gas/air supply system 18 including Venturi pipe 8 for mixing combustion gas with primary combustion air.

The burner matt/plate 7 covers a mixing chamber 6, to which the Venturi pipe 8 is connected or molded. An intake device 16 includes an input duct 10*a* for combustion gas, whose lower end opens into a combustion gas input nozzle 10, which feeds the combustion gas into the Venturi pipe 8. A parallelepiped-shaped air supply chamber 11 is connected upstream to the air entrance of the Venturi pipe. The air supply chamber 11 has an air inlet 12 for combustion air on at least one end. Also the gas feed nozzle 10 opens into the air supply chamber 11. This air supply chamber 11 has a definite volume, typically at least 2.5 liter, which damps sound waves arising in the combustion chamber in resonance, so that no disturbing acoustic oscillations arise and the combustion remains stable. The volumes for respective applications also can be smaller.

A structure of this type is called a Helmholz resonator in the acoustics field.

Figure 2:
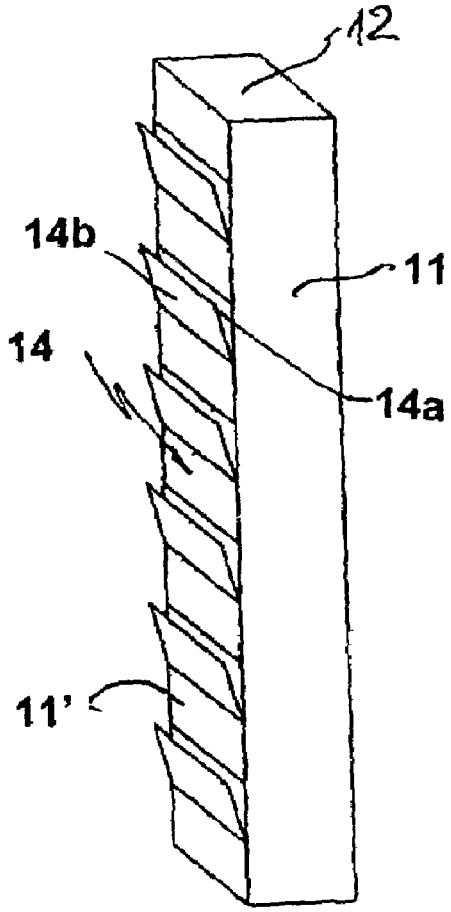
FIG. 2 is a perspective view of a parallelepiped-shaped oscillation-damping air supply chamber according to the present invention with perforations comprising a series of through-going openings partially covered with covers arranged in fish-scale-like array.

FIGS. 1 and 2 show a parallelepiped oscillation-damping air supply chamber 11 for the combustion gas/air supply system 18, which has a pattern 13, 14 of perforations according to the invention in addition to the main air inlet 12 on the outer end, through which additional combustion air can flow into the chamber, in order to supply the gas burner with a sufficient amount of air to attain the objects of the invention.

According to the embodiment shown in FIG. 1 this perforation pattern 13 comprises a series of through-going holes or perforations 13' arranged in a matrix array in exterior wall 11'. However the geometry and distribution of the through-going holes are freely selectable. The embodiments shown in FIG. 1 thus include numerous variants.

According to a second embodiment according to the invention the parallelepiped air supply chamber 11 is provided on one side with a fish scale-shaped perforation pattern 14, in which through-going openings 14*a* are provided one after the other on the exterior wall 11' of the chamber 11, which are partially covered by some fish scale-like covers 14*b*.

This "scale perforations" 14*a*, 14*b* have an especially advantageous form, since a comparatively large air entrance surface 14*a* is provided, but the actual operating form of the air supply chamber is not changed because of the overlapping of the openings 14*a* with the scales 14*b*. This means that its oscillation damping function as resonator can be completely fulfilled.

The perforation patterns 13, 14 can, as shown, extend over the entire height of the air supply chamber 11. However they can be formed according to the structure of the entire system so that they cover only a portion of the exterior wall 11', for example directly adjacent to the entrance mouth of the Venturi pipe 8, of the air supply chamber 11.

According to FIGS. 1 to 3A, 3B the air supply chamber 11 has a parallelepiped shape. However the perforated air supply chamber connected to the Venturi pipe 8 can also have other shapes, especially as shown in FIG. 2 of the above-mentioned U.S. patent application Ser. No. 10/978,571, which shows a channel-like air supply chamber partially encompassing the combustion chamber and/or heating apparatus wall and extending on both sides to the gas feed nozzle with air inlet openings on both of its ends and a rectangular cross-section. Alternatively according to FIG. 3 of the above-mentioned U.S. patent application Ser. No. 10/978,571 the air supply chamber is pipe-shaped and comprises different pipe segments of different diameters in order to provide a Helmholtz resonator in as short as possible distance as possible, i.e. to provide the conditions for compensation of the resonance oscillations in the combustion chamber.

Additional embodiments or configurations of the perforated air supply chamber are conceivable. Their shape may be selected freely, as long as the resonance damping conditions are fulfilled over the entire configuration and volume.

The same is true for other stated modifications (mechanical structure, etc) of the air supply chamber disclosed in U.S. patent application Ser. No. 10/978,571, which are suitable for the perforated air supply chamber according to the invention.

According to advantageous embodiments of the invention it is conceivable to adjust the size of the perforations to the air flow speed in the resonator, which is then especially of advantage, when the resonator has structure-depending radii, as described for example in FIG. 3 of the earlier cited patent application, i.e. curved sections. The speed loss depending on the curvature and thus the reduction of airflow rate can be compensated by the design of the perforations, e.g. larger openings downstream of the curved sections.

These effects can produce the following features:

Additional flow resistances arise within the resonator by each built in curved section. These resistances can cause result in an insufficient combustion air supply for the case burner in an undesirable case, which again can lead to combustion, which is not optimum. This situation can be compensated by introduction diverse perforations downstream of the curved section. This has the result that additional combustion air is drawn in through the additional perforations and thus the gas burner is supplied with sufficient air.

The above-described embodiments are also suitable for gas burners with blower assistance.

The disclosure in German Patent Application 10 2004 034 138.9-19 of Jul. 15, 2004 is incorporated here by reference. This German Patent Application describes the invention described hereinabove and claimed in the claims appended hereinbelow and provides the basis for a claim of priority for the instant invention under 35 U.S.C. 119.

While the invention has been illustrated and described as embodied in a gas-fired heating device, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims.

I claim:

1. A gas-fired heating apparatus comprising a combustion chamber (2);

at least one gas burner (5) arranged within said combustion chamber (2);

a combustion gas/air supply system (18) having an intake device (16) for combustion gas and primary combustion air to be mixed with the combustion gas, wherein said intake device (16) is arranged outside of the combustion chamber on the heating apparatus; and an oscillation-damping air supply chamber (11) connected to the combustion gas/air supply system (18), wherein said oscillation-damping air supply chamber (11) is provided with at least one main air inlet (12) through which a part of the primary combustion air is admitted to the air supply chamber (11), and said oscillation-damping air supply chamber (11) is a Helmholtz resonator and is connected to the intake device (16);

wherein the oscillation-damping air supply chamber (11) has an exterior wall (11') and a pattern (13, 14) of perforations in the exterior wall, said perforations acting as additional air inlets through which an additional part of the primary combustion air is admitted to the air supply chamber.

2. The gas-fired heating apparatus as defined in claim 1, wherein said pattern (13, 14) of said perforations extends completely over the exterior wall (11') of the oscillation-damping air supply chamber.

3. The gas-fired heating apparatus as defined in claim 1, wherein said pattern (13, 14) of said perforations extends over only a part of the exterior wall (11').

4. The gas-fired heating apparatus as defined in claim 3, wherein said part of the exterior wall is adjacent to an air intake of the combustion gas/air supply system (18).

5. The gas-fired heating apparatus as defined in claim 1, wherein said pattern of said perforations is a matrix array of through-going holes (13') extending over the exterior wall (11').

6. The gas-fired heating apparatus as defined in claim 1, wherein said pattern of said perforations is an array of through-going openings (14*a*), which are partially covered by outwardly bent covers (14*b*), said outwardly bent covers (14*b*) being in the shape of fish scales.

7. The gas-fired heating apparatus as defined in claim 6, wherein said through-going openings (14*a*) and said covers (14*b*) each have a rectangular shape.

8. The gas-fired heating apparatus as defined in claim 1, wherein said perforations have an open cross-section or area and said open cross-section or area is determined according to a flow speed existing in respective sections of the air supply chamber.

9. The gas-fired heating apparatus as defined in claim 1, wherein said air supply chamber (11) is parallelepiped shaped and said at least one main air inlet (12) is arranged on at least one side of the air supply chamber.

* * * * *